US009353604B2

(12) United States Patent
Stringfield et al.

(10) Patent No.: US 9,353,604 B2
(45) Date of Patent: May 31, 2016

(54) SINGLE TRIP GRAVEL PACK SYSTEM AND METHOD

(71) Applicant: Schlumberger Technology Corporation, Sugar Land, TX (US)

(72) Inventors: Barry Scott Stringfield, Sandnes (NO); Edvin Eimstad Riisem, Sandnes (NO); Terje Moen, Sandnes (NO); Bryan Stamm, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 530 days.

(21) Appl. No.: 13/839,706

(22) Filed: Mar. 15, 2013

(65) Prior Publication Data

US 2014/0014337 A1 Jan. 16, 2014

Related U.S. Application Data

(60) Provisional application No. 61/670,884, filed on Jul. 12, 2012.

(51) Int. Cl.
*E21B 43/04* (2006.01)
*E21B 43/14* (2006.01)

(52) U.S. Cl.
CPC ..... *E21B 43/04* (2013.01); *E21B 43/14* (2013.01)

(58) Field of Classification Search
CPC ..... E21B 43/04; E21B 43/14; E21B 43/25; E21B 43/08; E21B 2034/007; E21B 34/14; E21B 34/08
See application file for complete search history.

(56) References Cited

U.S. PATENT DOCUMENTS

| | | | | |
|---|---|---|---|---|
| 4,401,158 | A * | 8/1983 | Spencer et al. | 166/51 |
| 4,440,218 | A * | 4/1984 | Farley | 166/51 |
| 4,474,239 | A * | 10/1984 | Colomb et al. | 166/278 |
| 4,832,129 | A * | 5/1989 | Sproul et al. | 166/387 |
| 5,413,180 | A * | 5/1995 | Ross et al. | 166/387 |
| 6,311,772 | B1 * | 11/2001 | Myhre et al. | 166/278 |
| 6,464,006 | B2 * | 10/2002 | Womble | 166/276 |
| 7,017,664 | B2 * | 3/2006 | Walker et al. | 166/278 |
| 7,210,527 | B2 * | 5/2007 | Walker et al. | 166/278 |
| 7,337,840 | B2 * | 3/2008 | Penno | 166/278 |
| 7,735,566 | B2 | 6/2010 | Jones | |
| 8,770,290 | B2 * | 7/2014 | van Petegem et al. | 166/278 |
| 8,857,518 | B1 * | 10/2014 | Tips et al. | 166/313 |
| 9,068,435 | B2 * | 6/2015 | Broussard et al. | |

(Continued)

OTHER PUBLICATIONS

International Search Report and Written Opinion mailed on Sep. 25, 2013 for International Patent Application No. PCT/US2013/049528, filed on Jul. 8, 2013, 13 pages.

*Primary Examiner* — Jennifer H Gay
(74) *Attorney, Agent, or Firm* — Jeffery R. Peterson

(57) ABSTRACT

Systems and methods for completing a well. A lower completion assembly is run into a wellbore adjacent to a subsurface formation in a single trip. The lower completion assembly includes a screen assembly, an inner string, and a sealing device. The inner string has a return opening and at least one inflow control device communicating with an interior of the inner string. The barrier device actuates between a gravel packing position and an inflow control position. Gravel flows about the screen assembly with the barrier device in the gravel packing position during at least a portion of gravel pack operations. The barrier device is actuated to the inflow control position to restrict flow through the screen assembly during at least a portion of a well operation.

20 Claims, 7 Drawing Sheets

(56) References Cited

U.S. PATENT DOCUMENTS

| | | | | |
|---|---|---|---|---|
| 9,085,960 | B2 * | 7/2015 | van Petegem et al. | |
| 2003/0037925 | A1 * | 2/2003 | Walker et al. | 166/276 |
| 2003/0141061 | A1 * | 7/2003 | Hailey et al. | 166/278 |
| 2006/0162927 | A1 | 7/2006 | Walker et al. | |
| 2007/0084605 | A1 * | 4/2007 | Walker et al. | 166/313 |
| 2009/0095471 | A1 * | 4/2009 | Guignard et al. | 166/278 |
| 2010/0012318 | A1 * | 1/2010 | Luce et al. | 166/278 |
| 2010/0212895 | A1 | 8/2010 | Vickery et al. | |
| 2011/0030965 | A1 * | 2/2011 | Coronado | 166/332.7 |
| 2011/0073308 | A1 | 3/2011 | Assal et al. | |
| 2011/0303420 | A1 | 12/2011 | Thorkildsen et al. | |
| 2012/0103606 | A1 * | 5/2012 | Van Petegem et al. | 166/278 |
| 2012/0103608 | A1 | 5/2012 | Van Petegem et al. | |
| 2012/0103631 | A1 * | 5/2012 | Broussard et al. | 166/382 |
| 2013/0180709 | A1 * | 7/2013 | Ritter et al. | 166/247 |
| 2013/0248179 | A1 * | 9/2013 | Yeh et al. | 166/278 |
| 2014/0014337 | A1 * | 1/2014 | Stringfield et al. | 166/278 |
| 2014/0034308 | A1 * | 2/2014 | Holderman et al. | 166/279 |
| 2015/0047837 | A1 * | 2/2015 | Turner et al. | 166/254.2 |

* cited by examiner

SINGLE TRIP GRAVEL PACK SYSTEM AND METHOD

CROSS REFERENCE TO RELATED APPLICATIONS

This application claims the benefit of a related U.S. Provisional Application having Ser. No. 61/670,884 filed Jul. 12, 2012, entitled "A Single Trip Gravel Pack Method and System for a Well," to Barry Stringfield et al., the disclosure of which is incorporated by reference herein in its entirety.

BACKGROUND

Embodiments described herein generally relate to downhole tools. More particularly, such embodiments relate to a downhole tool for gravel packing an annulus between a base pipe and a subterranean formation.

Hydrocarbons produced from a subterranean formation oftentimes have sand or other particulates dispersed therein. As the sand is undesirable to produce, many techniques exist for reducing the sand content in the hydrocarbons. Gravel packing is one technique used to filter and separate the sand from the hydrocarbons in a wellbore.

Gravel packing generally involves running a base pipe into the wellbore. A filter media is wrapped around a perforated section of the base pipe positioned adjacent to the hydrocarbon-producing formation. A gravel slurry, including gravel particulates dispersed within a carrier fluid, is pumped down a work string and into the annulus formed between the screen assembly and the wall of the wellbore. The carrier fluid flows through the screen assembly and back up to the surface through the work string while the gravel particulates remain disposed in the annulus between the screen assembly and the wall of the wellbore. The gravel particulates are used to filter and separate the sand from the hydrocarbons as the hydrocarbons flow from the formation through the screen assembly and into the interior of the base pipe.

What is needed is an improved system and method for gravel packing an annulus between a base pipe and a subterranean formation in a single trip.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A method for completing a well is disclosed. The method includes running a lower completion assembly into a wellbore adjacent to a subsurface formation in a single trip. The lower completion assembly can include a screen assembly, an inner string, and a barrier device. The inner string can have a return opening and at least one inflow control device communicating with an interior of the inner string. The barrier device can actuate between a gravel packing position for selectively permitting relatively unrestricted flow through the screen assembly and the return opening, and an inflow control position that directs an increased proportion of fluid flow to pass through the inflow control device of the inner string for selectively permitting relatively restricted flow through the screen assembly. Gravel can flow about the screen assembly with the bather device in the gravel packing position during at least a portion of gravel pack operations. The barrier device can actuate to the inflow control position to restrict flow through the screen assembly during at least a portion of a well operation.

A well system is also disclosed. The system can include an inner tubular disposed in a screen assembly. The inner tubular can have at least one inflow control device and a return opening. A barrier device can be disposed between the inner tubular and the screen assembly. The barrier device can actuate between a gravel packing position for selectively permitting relatively unrestricted flow through the screen assembly and the return opening, and a inflow control position that directs an increased proportion of flow through the screen assembly to pass through the inflow control device. A packer can be disposed proximate the screen assembly. The packer can be actuated when the barrier device is in the gravel packing position.

In another embodiment, the method includes running a lower completion assembly into a wellbore adjacent to a subsurface formation in a single trip. The lower completion assembly can include a screen assembly, an inner string, and a barrier device. The inner string can be disposed in the screen assembly and has at least one inflow control device. The barrier device can be disposed between the inner string and the screen assembly. The barrier device can actuate between a first position and a second position to provide pressure loss during at least a portion of a first well operation that is less than the pressure loss through at least a portion of a second well operation. Gravel can flow about the screen assembly with the barrier device in the first position during at least a portion of gravel pack operations. The barrier device can actuate to the second position to restrict flow through the screen assembly during at least a portion of well operations.

BRIEF DESCRIPTION OF THE DRAWINGS

So that the recited features may be understood in detail, a more particular description, briefly summarized above, may be had by reference to one or more embodiments, some of which are illustrated in the appended drawings. It is to be noted, however, that the appended drawings are illustrative embodiments, and are, therefore, not to be considered limiting of its scope.

DETAILED DESCRIPTION

Figure 1:
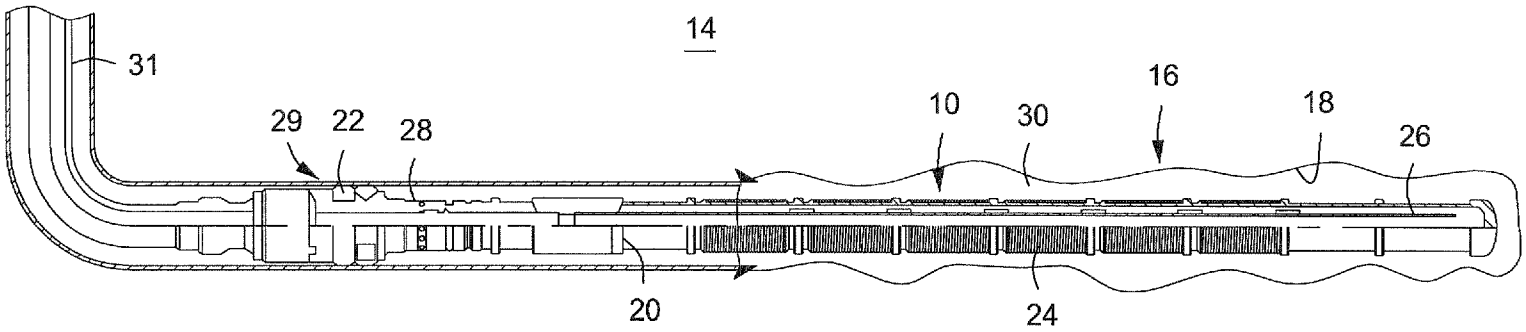
FIG. 1 depicts a cross-sectional side view of an illustrative downhole tool for gravel packing a wellbore, according to one or more embodiments disclosed.

FIG. 1 depicts a cross-sectional side view of an illustrative downhole tool 10 for gravel packing a wellbore 16, according to one or more embodiments. The downhole tool 10 includes a base pipe 20, a packer 22, a filter media 24, and an inner string (e.g., an inner tubular or washpipe) 26. The downhole tool 10 can also include one or more shunt tubes (not shown) for use in gravel packing.

The downhole tool 10 is disposed in the wellbore 16 and is positioned adjacent to a hydrocarbon formation 14. The wellbore 16 can have a casing disposed therein, or the wellbore 16 can be openhole (i.e., no casing disposed therein), as shown in FIG. 1. A wellbore annulus 30 is formed between the base pipe 20 (and/or the filter media 24) and a wall 18 of the wellbore 16. The downhole tool 10 is coupled together to form a lower completion assembly 29. The lower completion assembly 29 is attached to a service tool 28 and run into the wellbore 16 with a drill pipe or other tubular member 31.

Figure 2:
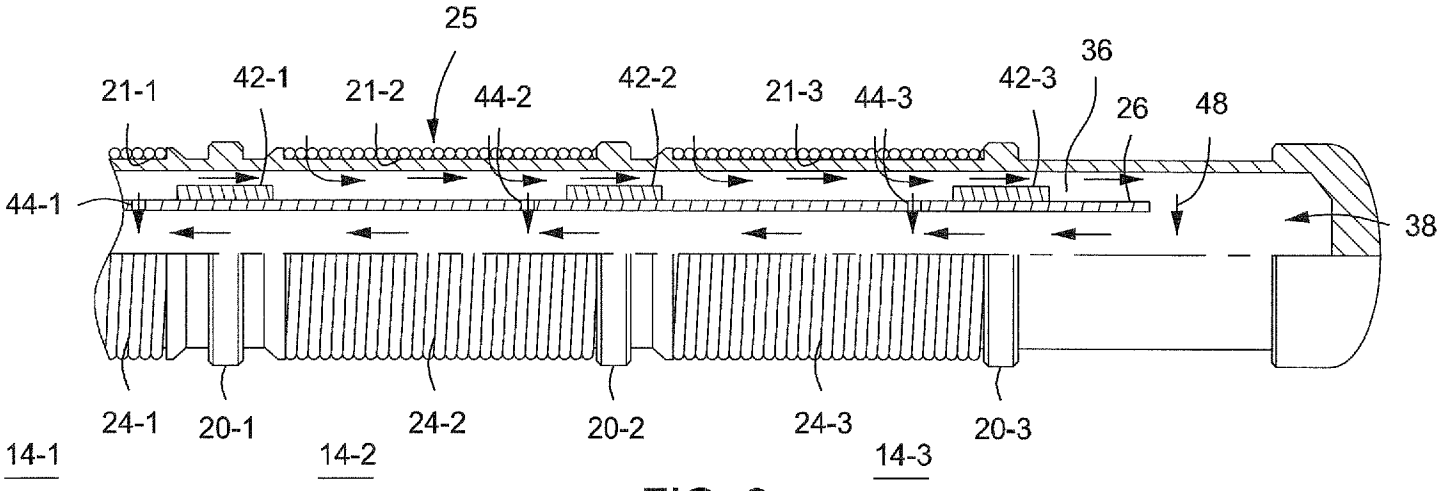
FIG. 2 depicts a partial cross-sectional side view of the downhole tool showing one or more illustrative barrier devices in a gravel packing position, according to one or more embodiments disclosed.

FIG. 2 depicts a partial cross-sectional view of the downhole tool 10 showing one or more illustrative barrier devices or assemblies (three are shown 42-1, 42-2, and 42-3) in a gravel packing position or configuration, according to one or more embodiments. Referring now to FIGS. 1 and 2, the base pipe 20 is a tubular member having an axial bore formed therethrough. The base pipe 20 can include one or more non-permeable sections (three are shown 20-1, 20-2, 20-3) and one or more permeable sections (three are shown 21-1, 21-2, 21-3). The non-permeable sections 20-1, 20-2, 20-3 can be solid such that no fluid can flow radially therethrough, and the permeable sections 21-1, 21-2, 21-3 can have one or more openings, slots, or perforations formed radially therethrough through which fluid can flow. In an embodiment, the base pipe 20 may be referred to as perforated base pipe where a plurality of perforations are formed in the base pipe 20 to form permeable sections 21-1, 21-2, 21-3. The perforations may be slits, punctures, or other openings in the base pipe 20. In an embodiment, the plurality of perforations provides a flow area resulting in substantially unrestricted flow through the base pipe 20.

The packer 22 is disposed radially-outward from the base pipe 20. In an embodiment, the packer 22 is a gravel packer. The packer 22 is adapted to actuate from a run-in position to a sealing position. In the run-in position, the packer 22 is not in contact with the wall 18 of the wellbore 16 (or casing). However, when the packer 22 actuates into the sealing position, the packer 22 expands radially-outward into contact with the wall 18 of the wellbore (or casing), thereby forming a seal between the base pipe 20 and the wall 18 of the wellbore 16. The seal provided by the packer 22 substantially restricts flow across the packer 22; however, in some embodiments, there may be some leakage across the seal.

The filter media 24 is also disposed radially-outward from the base pipe 20. The filter media 24 can be disposed below (i.e., closer to the bottom or toe of the wellbore 16) the packer 22 in the wellbore 16. The filter media 24 can be a screen, such as a wire-wrapped screen, direct-wrap screen, mesh screen, a slotted liner, or the like. The filter media 24 can also be or include sand filters that function to filter particles from fluids in the wellbore 16 and/or the formation 14. The filter media 24 is adapted to have fluid flow from a wellbore annulus 30 through the filter media 24 and the permeable sections 21-1, 21-2, 21-3 of base pipe 20 to an inner string annulus 36 formed between the base pipe 20 and the inner string 26. The inner string 26 is a tubular disposed within base pipe 20 that is axially moveable within base pipe 20 and may also be referred to as a washpipe.

The filter media 24 can include one or more screen sections (three are shown 24-1, 24-2, 24-3). For example, the first screen section 24-1 can be disposed around the first permeable section 21-1 of the base pipe 20, the second screen section 24-2 can be disposed around the second permeable section 21-2 of the base pipe 20, and the third screen section 24-3 can be disposed around the third permeable section 21-3 of the base pipe 20. The combination of the permeable sections 21-1, 21-2, 21-3 of the base pipe 20 and the screen sections 24-1, 24-2, 24-3 disposed therearound is referred to herein as a screen assembly 25. Each screen section 24-1, 24-2, 24-3 of the filter media 24 can be separated by a non-permeable section 20-1, 20-2, and 20-3 of the base pipe 20, respectively (as shown), or another non-permeable tubular.

The inner string 26 extends axially within the base pipe 20 and includes a return opening 38 that may be located proximate an axial end thereof. The return opening 38 may be referred to as a washpipe return opening 38. In an embodiment, the return opening 38 is disposed at the toe of the inner string 26. The inner string 26 further includes one or more barrier devices (42-1, 42-2, and 42-3) disposed on an outer radial surface thereof that are axially and/or circumferentially offset from one another.

The barrier devices 42-1, 42-2, and 42-3 can be packers that include an expandable or swellable element. In another embodiment, the barrier devices 42-1, 42-2, and 42-3 can include a valve or sliding sleeve that can be positioned to block or obstruct the inner string return opening 38. The barrier devices 42-1, 42-2, and 42-3 can be actuated chemically, hydraulically, electrically or mechanically. The barrier devices 42-1, 42-2, and 42-3 restricts or blocks flow. In some embodiments, the barrier devices 42-1, 42-2, and 42-3 can provide a fluid pressure seal. In other embodiments, barrier devices 42-1, 42-2, and 42-3 do not provide a fluid pressure seal and instead restrict or block fluid flow.

The inner string 26 further includes one or more inflow control devices or "ICDs" (three are shown 44-1, 44-2, 44-3). The inflow control devices 44-1, 44-2, 44-3 are arranged and designed to the balance (e.g., by choking) the inflow of fluids from the inner string annulus 36 into the interior of the inner string 26 along the length of the inner string 26. The inflow control devices 44-1, 44-2, 44-3 can be or include nozzles, tortuous flow paths, check valves, plates, adjustable inflow control devices, self-adjustable inflow control devices, or any other inflow control devices known in the art. The inflow control devices 44-1, 44-2, 44-3 are axially and/or circumferentially offset from one another and disposed radially through the wall of the inner string 26. At least one barrier device (e.g., 42-3) can be positioned on the inner string 26 and between an inflow control device (e.g., 44-3) and the return opening 38.

During the gravel pack operation, the inflow control devices 44-1, 44-2, 44-3 can be open, restricted, and/or closed. When the inflow control devices 44-1, 44-2, 44-3 are open, fluid is able to flow through the inflow control devices 44-1, 44-2, 44-3 without restriction. When the inflow control devices 44-1, 44-2, 44-3 are restricted, fluid flow through the inflow control devices 44-1, 44-2, 44-3 is reduced or choked. When the inflow control devices 44-1, 44-2, 44-3 are closed, no fluid is able to flow through the openings in the inflow control devices 44-1, 44-2, 44-3.

The barrier devices 42-1, 42-2, and 42-3 shown in FIG. 2 are in the gravel packing position. When in the gravel packing position, a radial gap exists between the barrier devices 42-1, 42-2, and 42-3 and the inner surface of the base pipe 20. This allows fluid to flow axially through the inner string annulus 36 via a first flow path 48. During a gravel packing operation, gravel is placed in the wellbore annulus 30, and gravel pack fluid flows through the filter media assembly 24, through the permeable sections 21-1, 21-2, 21-3 of the base pipe 20, and into the inner string annulus 36. After reaching the inner string annulus 36, the gravel pack fluid flows through the first flow path 48, as shown by arrows in FIG. 2, to the interior of the inner string 26. The flow through the screen assembly 25 and the return opening 38 is relatively unrestricted when the barrier devices 42-1, 42-2, and 42-3 and lower completion assembly 29 is in the gravel packing position. In contrast the flow through screen assembly 25 and return opening 38 is restricted and/or closed when the barrier devices 42-1, 42-2, and 42-3 and lower completion assembly 29 is in the inflow control position. The selected restricted flow through the screen assembly 25 and lower completion assembly 29 is due to an increased proportion of the flow through the screen assembly being directed to and flowing through the inflow control devices 44-1, 44-2, 44-3.

More specifically, a portion of the gravel pack fluid flows axially through the first flow path 48 in the inner string annulus 36 and enters into the interior of the inner string 26 through the inner string return opening 38. In some embodiments, another portion of the gravel pack fluid flowing through the first flow path 48 in the inner string annulus 36 flows into the interior of the inner string 26 by flowing through the inflow control devices 44-1, 44-2, 44-3 in the inner string 26. The inflow control devices 44-1, 44-2, 44-3 restrict the flow of fluid from the inner string annulus 36 to the interior of the inner string 26, while the flow path in the inner string annulus 36 to the inner string return opening 38 is relatively unrestricted. As such, in some embodiments a greater proportion of the fluid flowing in the first flow path 48 flows into the interior of the inner string 26 by flowing into the return opening 38 of the inner string 26, and a smaller proportion of the gravel packing fluid enters the interior of the inner string 26 through the inflow control devices 44-1, 44-2, 44-3. For example, a (volumetric) ratio of the fluid flowing through the return opening 38 to the fluid flowing through the inflow control devices 44-1, 44-2, 44-3 can be between about 1.5:1 and about 3:1, between about 2:1 and about 5:1, between about 5:1 and about 10:1, between about 10:1 and about 20:1, between about 20:1 and about 50:1, between about 50:1 and about 100:1, or more.

The barrier devices 42-1, 42-2, 42-3 are in the gravel packing position during gravel pack operations in order to reduce pressure loss as gravel pack fluid flows from the wellbore annulus 30 to the inner string annulus 36 and into the interior of the inner string 26. Reducing this pressure loss during gravel packing operations is intended to assist in the gravel packing operations. The gravel packing position allows the gravel slurry to be dehydrated at a flow rate through the filter media 24 that allows for the gravel in the gravel pack slurry to be adequately packed against the filter media 24 in the wellbore annulus 30. Without a sufficient flow rate of the carrier fluid through the filter media 24, an adequate gravel pack in the wellbore annulus 30 may not be achieved.

Figure 3:
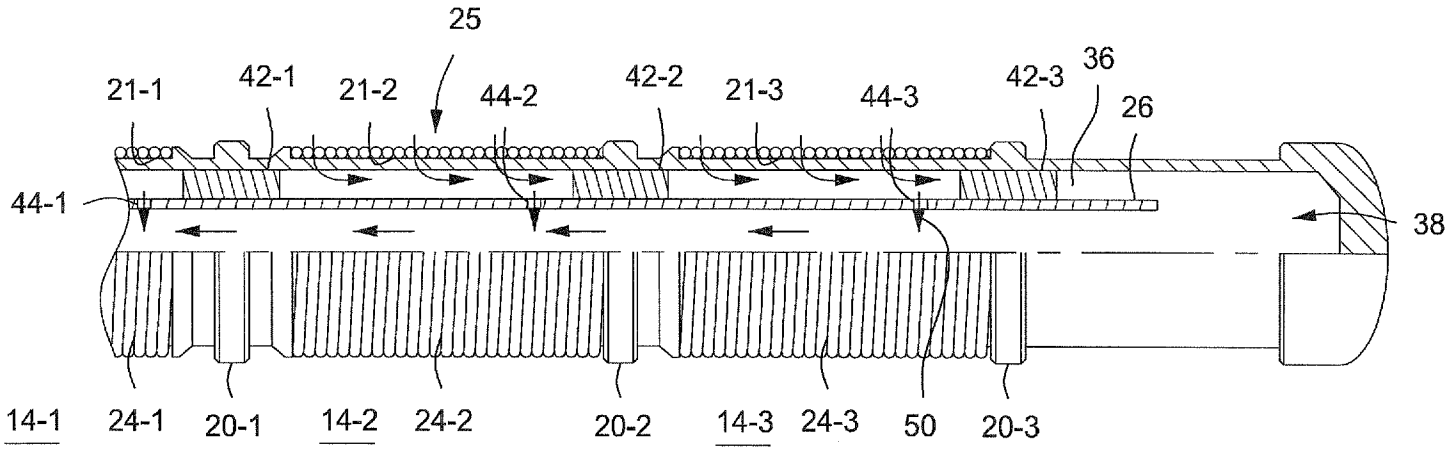
FIG. 3 depicts a partial cross-sectional side view of the downhole tool showing the barrier devices of FIG. 2 in an inflow control position, according to one or more embodiments disclosed.

FIG. 3 depicts a partial cross-sectional view of the downhole tool 10 showing the barrier devices 42-1, 42-2, 42-3 in an inflow control position or configuration, according to one or more embodiments. After gravel packing is complete, the barrier devices 42-1, 42-2, 42-3 are actuated such that the barrier devices 42-1, 42-2, 42-3 block or obstruct axial fluid flow through the inner string annulus 36 and into the inner string return opening 38. In an embodiment, the barrier devices 42-1, 42-2, 42-3 may provide some leakage flow after actuation and when obstructing axial fluid flow. In some embodiments, the barrier devices 42-1, 42-2, and 42-3 provide a fluid pressure seal.

In one embodiment, the barrier devices 42-1, 42-2, 42-3 are packers and can be set by applying internal pressure to the interior of the inner string 26 to raise the fluid pressure in the interior of the inner string 26 above a predetermined packer actuation pressure. At least one of the inflow control devices 44-1, 44-2, 44-3 can include a check valve for blocking fluid from flowing therethrough from the interior of the inner string 26 to the inner string annulus 36. An example of an inflow control device 44-1, 44-2, 44-3 that includes a check valve is disclosed in U.S. Patent Publication No. U.S. 2011/0303420 A1, titled "Method and Apparatus for Use with an Inflow Control Device." In addition, a return check valve (not shown) can be disposed proximate the inner string return opening 38 to block fluid from flowing from the interior of the inner string 26 to the inner string annulus 36 through the return opening 38 of the inner string 26. The return check valve can be a butterfly valve or other check valve. Use of inflow control devices 44-1, 44-2, 44-3 including a check valve and an inner string return opening 38 including a return check valve allows the interior of the inner string 26 to be pressured up to the packer actuation pressure by applying fluid pressure through the service tool 28.

The barrier devices 42-1, 42-2, 42-3 of FIG. 3 have been actuated radially-outward to form a barrier between the inner string 26 and the base pipe 20 to block (axial) fluid flow in the inner string annulus 36 from reaching the inner string return opening 38. When the barrier devices 42-1, 42-2, 42-3 are in the inflow control position, a second inner string flow path 50 is formed so that well fluid in the wellbore annulus 30 flows through the filter media 24 and through the permeable sections 21-1, 21-2, 21-3 of the base pipe 20 to inner string annulus 36 via the second flow path 50. In some embodiments, barrier devices 42-1, 42-2, 42-3 in the inflow control position allow a relative restricted flow past the barrier or restriction formed.

After reaching the inner string annulus 36, the well fluid flows in the second flow path 50, as shown by arrows in FIG. 3, to the interior of the inner string 26. More specifically, the well fluid flows from the inner string annulus 36 into the interior of the inner string 26 through the inflow control devices 44-1, 44-2, 44-3 in the inner string 26. The barrier devices 42 block the axial flow of the fluid to the inner string return opening 38. In an embodiment, there can be some limited fluid flow to the inner string return opening 38 when the barrier devices 42-1, 42-2, 42-3 are in the inflow control position and blocking fluid flow to the inner string return opening 38.

The barrier devices 42-1, 42-2, 42-3 are in the inflow control position during at least a portion of production operations where hydrocarbons flow from the formation to the interior of the inner string 26 and are produced to the surface. Because of the restricted flow area through the inflow control devices 44-1, 44-2, 44-3 and to the interior of the inner string 26, there is a pressure loss as the well fluid (e.g., hydrocarbon fluid) flows therethrough from the inner string annulus 36 into the interior of the inner string 26. By actuating the barrier devices 42-1, 42-2, 42-3 into the inflow control position, the downhole tool 10 provides pressure loss during gravel packing that is less than the pressure loss through at least a portion of production operations. Actuating the bather devices 42-1, 42-2, 42-3 into the inflow control position allows for controlled flow of well fluids into the interior of the inner string 26 and to the surface of the well.

The barrier devices 42-1, 42-2, 42-3 allow for zonal compartmentalization of fluid from the formation 14. The formation 14 can include a plurality of formation zones 14-1, 14-2, and 14-3 that are adjacent to filter media or screen sections 24-1, 24-2, and 24-3, respectively. The inner string 26 is positioned such that barrier devices 42-1, 42-2, 42-3 will compartmentalize the fluid flow from adjacent formation zones 14-1, 14-2, and 14-3 through the different screen sections 24-1, 24-2, and 24-3. For example, fluid flow from formation zone 14-2 flowing through screen section 24-2 flows to the section of inner string annulus 36 sealed by barrier device 42-1 and barrier device 42-2. The fluid then flows through the inflow control device 44-2 between barrier device 42-1 and barrier device 42-2 and into the interior of the inner string 26.

The barrier devices 42-1, 42-2, 42-3 allow for fluid flow control from the different formation zones 14-1, 14-2, 14-3. Fluid flow control from the different zones 14-1, 14-2, 14-3 can be desired, for example, when a particular zone begins producing an excess amount of water. For example, a sensor (not shown) located on or associated with the lower completion can sense water or a water/oil ratio for formation zone 14-2. The inflow control device 44-2 associated with formation zone 14-2 can be an on/off adjustable inflow control device that can be actuated to an off position in response to a predetermined well condition. For example, the on/off adjustable inflow control devices 44-1, 44-2, 44-3 can be actuated hydraulically, electrically, chemically, or mechanically in response to information sensed by the sensor. In another embodiment, a sliding sleeve can be adapted to move to block or further choke the flow through the inflow control device 44-2 associated with formation zone 14-2.

Figure 4:
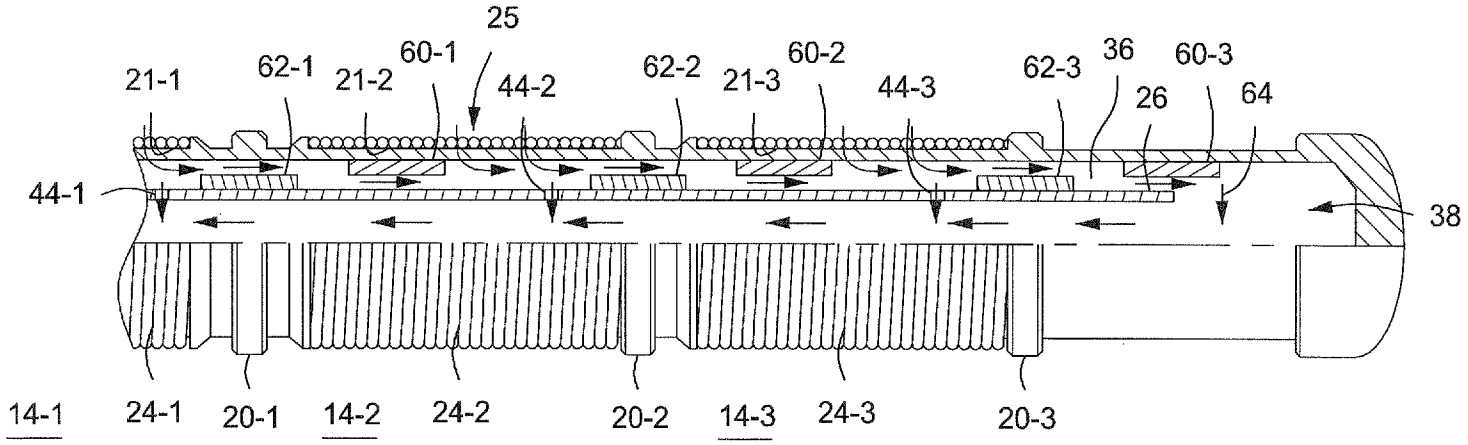
FIG. 4 depicts a partial cross-sectional side view of the downhole tool showing one or more illustrative barrier devices in a gravel packing position, according to one or more embodiments disclosed.
Figure 5:
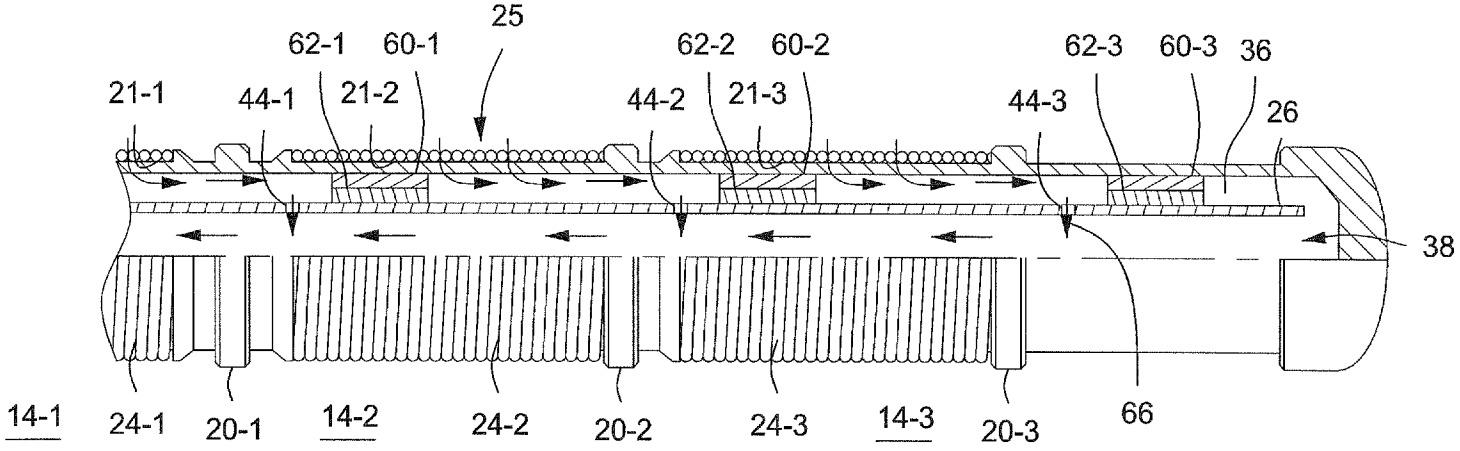
FIG. 5 depicts a partial cross-sectional side view of the downhole tool showing the barrier devices of FIG. 4 in an inflow control position, according to one or more embodiments disclosed.

FIG. 4 depicts a partial cross-sectional view of the downhole tool 10 showing one or more illustrative barrier devices or assemblies 60-1, 60-2, 60-3 in a gravel packing position, and FIG. 5 depicts a partial cross-sectional view of the downhole tool 10 showing the barrier devices 60-1, 60-2, 60-3 in a inflow control position, according to one or more embodiments disclosed. As shown, one or more barrier devices (three are shown 60-1, 60-2, 60-3) can be disposed on the inner surface of the base pipe 20 and extend or protrude radially-inward therefrom. The barrier devices 60-1, 60-2, 60-3 on the base pipe 20 can be axially and/or circumferentially offset from one another. In at least one embodiment, the barrier devices 60-1, 60-2, 60-3 on the base pipe 20 can be a polished bore receptacle or "PBR."

One or more corresponding barrier devices or assemblies (three are shown 62-1, 62-2, 62-3) can be disposed on the outer surface of the inner string 26 and extend or protrude radially-outward therefrom. The barrier devices 62-1, 62-2, 62-3 on the inner string 26 can be axially and/or circumferentially offset from one another. In at least one embodiment, the barrier devices 62-1, 62-2, 62-3 on the inner string 26 can be or include bonded seals (e.g., O-ring seals).

When the downhole tool 10 is in the gravel packing position, as shown in FIG. 4, the barrier devices 60-1, 60-2, 60-3 on the base pipe 20 can be axially offset from the corresponding barrier devices 62-1, 62-2, 62-3 on the inner string 26 such that fluid can flow axially through the inner string annulus 36 to the return opening 38 via a flowpath 64. When the downhole tool 10 is actuated into the inflow control position, as shown in FIG. 5, the barrier devices 60-1, 60-2, 60-3 on the base pipe 20 can be axially aligned with the corresponding barrier devices 62-1, 62-2, 62-3 on the inner string 26 such that axial fluid flow through the inner string annulus 36 is blocked or obstructed. More particularly, the barrier devices 60-1, 60-2, 60-3 on the base pipe 20 may engage the barrier devices 62-1, 62-2, 62-3 on the inner string 26 to form a seal in the inner string annulus 26 such that the fluid in the inner string annulus 26 diverts to a flowpath 66. The downhole tool 10 may be actuated into the inflow control position by moving the inner string 26 axially with respect to the base pipe 20.

Figure 6:
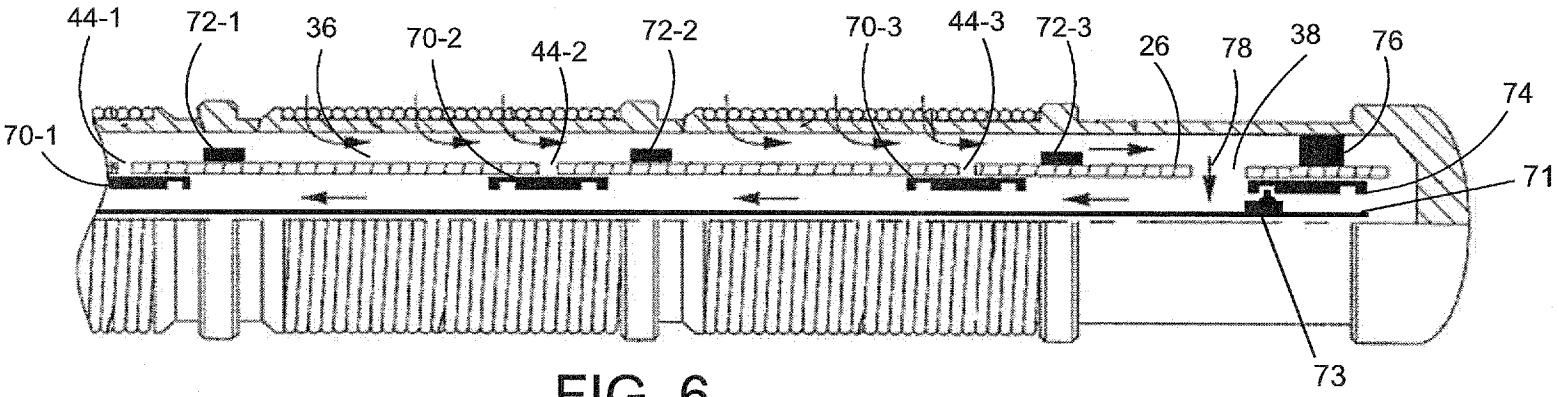
FIG. 6 depicts a partial cross-sectional side view of the downhole tool showing one or more illustrative barrier devices in a gravel packing position, according to one or more embodiments disclosed.
Figure 7:
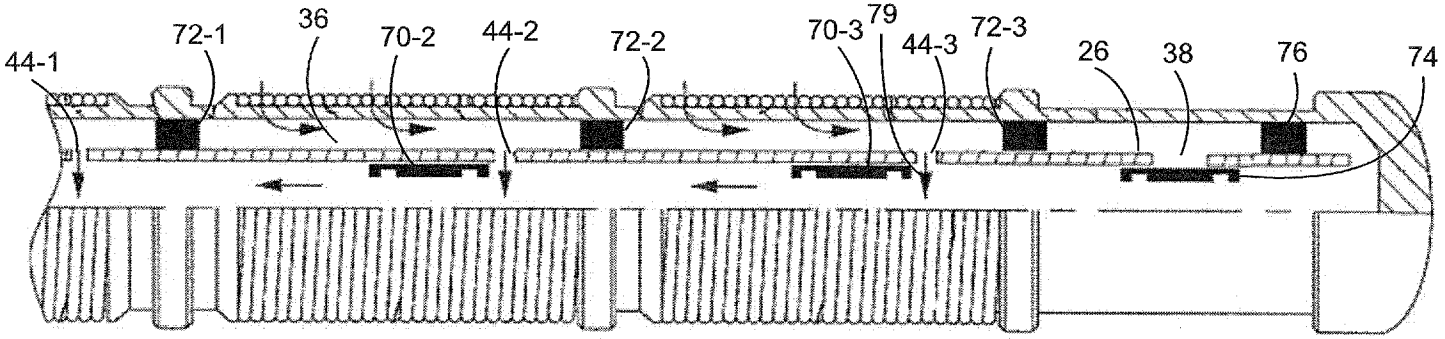
FIG. 7 depicts a partial cross-sectional side view of the downhole tool showing the barrier devices of FIG. 6 in an inflow control position, according to one or more embodiments disclosed.

FIG. 6 depicts a partial cross-sectional view of the downhole tool 10 showing one or more illustrative barrier devices or assemblies 72-1, 72-2, 72-3 in a gravel packing position, and FIG. 7 depicts a partial cross-sectional view of the downhole tool 10 showing the barrier devices 72-1, 72-2, 72-3 in a inflow control position, according to one or more embodiments disclosed. As shown, one or more barrier devices (three are shown 72-1, 72-2, 72-3) can be disposed on the outer surface of the inner string 26 and extend or protrude radially-outward therefrom. The barrier devices 72-1, 72-2, 72-3 on the inner string 26 can be axially and/or circumferentially offset from one another. In at least one embodiment, the barrier devices 72-1, 72-2, and 72-3 can be packers that include an expandable or swellable element. The barrier devices 72-1, 72-2, and 72-3 can be actuated chemically, hydraulically, electrically or mechanically.

One or more inner barrier devices or assemblies (three are shown 70-1, 70-2, and 70-3) can be disposed on an inner surface of the inner string 26. The inner barrier devices 70-1, 70-2, and 70-3 can be or include valves or sliding sleeves that can be positioned to block or obstruct the inflow control devices 44-1, 44-2, 44-3, respectively. An end valve or sliding sleeve 74 can be positioned to block or obstruct the return opening 38. In some embodiments, the inner barrier devices 70-1, 70-2, and 70-3 and end valve or sliding sleeve 74 can be selectively positioned in intermediate positions that provide partial blockage of flow through ICDs 44-1, 44-2 and 44-3 and return port 38. Positioning the inner barrier devices 70-1, 70-2, and 70-3 in intermediate positions could provide another method of providing increasing or controlled inflow control for the filter media 24 during production operations. An end packer 76 can be positioned between the return opening 38 and a terminal end of the inner string 26, forming a seal or barrier therebetween.

When the downhole tool 10 is in the gravel packing position, as shown in FIG. 6, the barrier devices 72-1, 72-2, 72-3 on the inner string 26 can be radially offset from the base pipe 20 such that fluid can flow axially through the inner string annulus 36 to the return opening 38 via a flowpath 78. In the gravel packing position, the inner barrier devices 70-1, 70-2, and 70-3 can be positioned to block or obstruct the inflow control devices 44-1, 44-2, 44-3, respectively.

When the downhole tool 10 is actuated into the inflow control position, as shown in FIG. 7, the barrier devices 72-1, 72-2, and 72-3 on the base pipe 20 can be actuated radially-outward on the inner string 26 such that axial fluid flow through the inner string annulus 36 is blocked or obstructed. In the inflow control position, the inner barrier devices 70-1, 70-2, and 70-3 can move axially with respect to the inner string 26 to unblock the one or more of the inflow control devices 44-1, 44-2, 44-3 to allow fluid to flow therethrough. As such, the fluid then flows through the flow path 79. The barrier devices 70-1, 70-2, and 70-3 can be used for the other embodiments described including the embodiments described and illustrated for FIG. 2 through FIG. 5.

Figure 8:
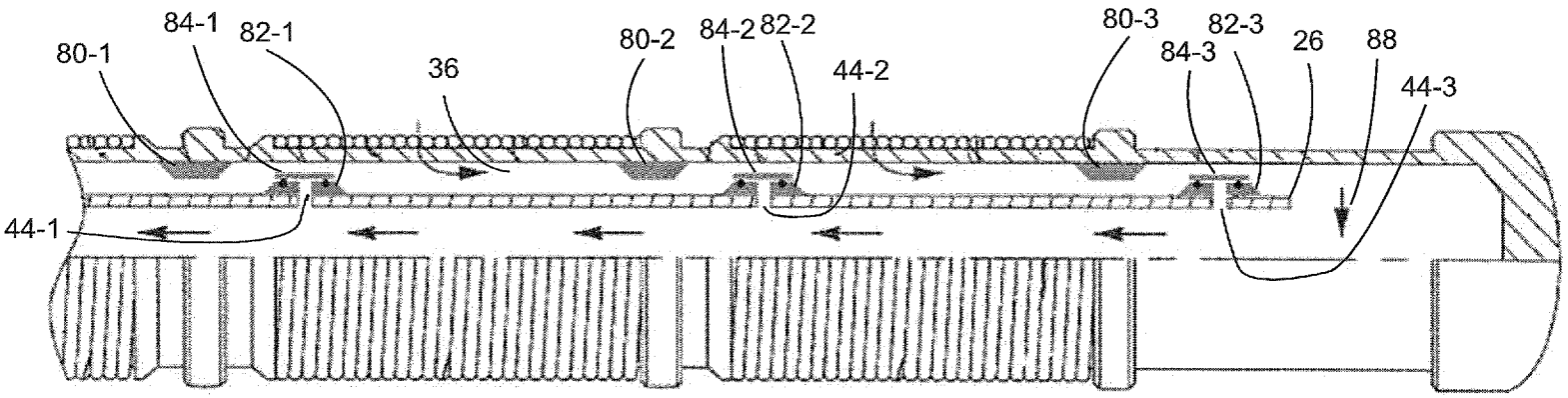
FIG. 8 depicts a partial cross-sectional side view of the downhole tool showing one or more barrier devices in a gravel packing position, according to one or more embodiments disclosed.
Figure 9:
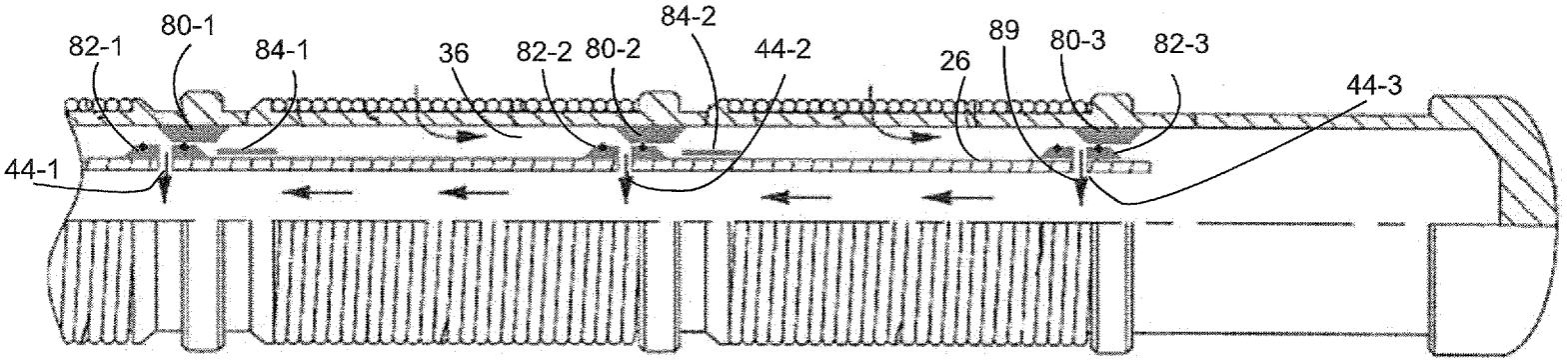
FIG. 9 depicts a partial cross-sectional side view of the downhole tool showing the barrier devices of FIG. 8 in an inflow control position, according to one or more embodiments disclosed.

FIG. 8 depicts a partial cross-sectional view of the downhole tool 10 showing one or more illustrative first barrier devices or assemblies 82-1, 82-2, 82-3 in a gravel packing position, and FIG. 9 depicts a partial cross-sectional view of the downhole tool 10 showing the first barrier devices 82-1, 82-2, 82-3 in an inflow control position, according to one or more embodiments disclosed. As shown, one or more first barrier devices (three are shown 82-1, 82-2, 82-3) can be disposed on the outer surface of the inner string 26 and extend or protrude radially-outward therefrom. The first barrier devices 82-1, 82-2, 82-3 on the inner string 26 can be axially and/or circumferentially offset from one another. In at least one embodiment, the first barrier devices 82-1, 82-2, and 82-3 can be formed from an elastomeric, ceramic, or metallic material. The first barrier devices 82-1, 82-2, and 82-3 can contain a bore that is axially aligned with the inflow control devices 44-1, 44-2, and 44-3, respectively. One or more sleeves 84-1, 84-2, and 84-3 can seal the bore through the barrier devices 82-1, 82-2, 82-3, respectively.

One or more second barrier devices or assemblies (three are shown 80-1, 80-2, and 80-3) can be disposed on an inner surface of the base pipe 20 and extend or protrude radially-inward therefrom. The second barrier devices 80-1, 80-2, and 80-3 on the base pipe 20 can be axially and/or circumferentially offset from one another. When the downhole tool 10 is in the gravel packing position, the fluid may flow through the flowpath 88. When the downhole tool 10 is in the inflow control position, as shown in FIG. 9, the first barrier devices 82-1, 82-2, and 82-3 can be positioned to remove the seal between the one or more sleeves 84-1, 84-2, and 84-3 and the inflow control devices 44-1, 44-2, and 44-3. When the second barrier devices 80-1, 80-2, and 80-3 are aligned with and contact the first barrier devices 82-1, 82-2, 82-3, axial fluid flow through the inner string annulus 36 can be blocked or obstructed. In this position, flow in the inner string annulus 36 is diverted through the inflow control devices 44-1, 44-2, 44-3 via flowpath 89. The inflow control devices 44-1, 44-2, 44-3 can be positioned by axially moving the inner string 26.

Figure 10:
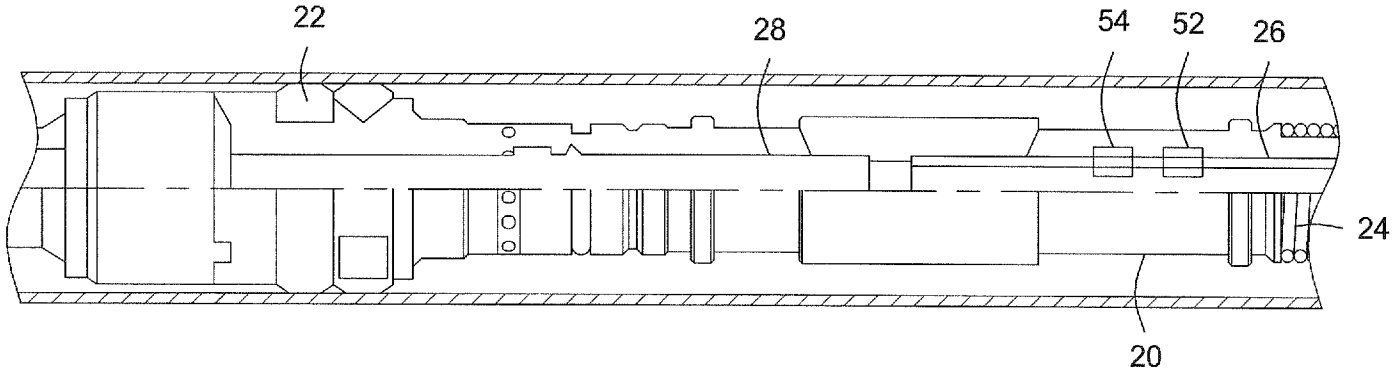
FIG. 10 depicts a partial cross-sectional side view of an illustrative inner string anchoring assembly in the downhole tool, according to one or more embodiments disclosed.

FIG. 10 depicts a partial cross-sectional view of an illustrative inner string anchoring assembly 52 in the downhole tool 10, according to one or more embodiments. A top portion of the downhole tool 10 can include an inner string anchoring assembly 52 and an inner string disconnect assembly 54 disposed on the inner string 26. The inner string disconnect assembly 54 and inner string anchoring assembly 52 are located axially above the barrier devices 42-1, 42-2, 42-3 and the inflow control devices 44-1, 44-2, 44-3. The inner string anchoring assembly 52 is adapted to be actuated between a non-anchored position and an anchored position. The anchoring assembly 52 functions to connect or anchor the inner string 26 to the rest of the lower completion assembly 29 when in the anchoring position. The anchoring assembly 52 is run in hole in the non-anchored position. When in the non-anchored position, the anchoring assembly 52 does not connect the inner string 26 to the other lower completion components so that the inner string 26 can be axially moved relative to the base pipe 20. After the inner string 26 has been decoupled from the base pipe 20, the service string 28 is used to move the inner string 26 axially. When in the anchored position, the anchoring assembly 52 connects the inner string 26 to the base pipe 20.

In one embodiment, the inner string anchoring assembly 52 connects the inner string 26 to the base pipe 20, and the inner string 26 and base pipe 20 are permanently joined together when the lower completion 29 is run in the wellbore 16. A three way sub component can be used to connect the inner string 26 and base pipe 20 together. In this embodiment, the portion of the inner string 26 disposed within the screen sections 24-1, 24-2, 24-3 is not axially moveable with respect to the base pipe 20. In this embodiment, the service tool 28 can be disconnected in a conventional manner from the permanent lower completion 29 that remains in the wellbore 16. The barrier device can be activated 42-1, 42-2, and 42-3 without axial movement of the inner string 26, for example as described for embodiments shown in FIG. 3 and FIG. 4.

In addition, the inner bather devices 70-1, 70-2, and 70-3, shown in FIG. 6 and FIG. 7, can be actuated with a separate shifting tool string 71 having a shifting tool 73 and disposed within the inner string 26. The shifting tool string 71 is run in hole with the lower completion 29. The inner bather devices 70-1, 70-2, and 70-3 can be actuated by axially moving the shifting tool string 71 and shifting tool 73 past the inner barrier devices. The shifting tool 73 engages the inner barrier devices 70-1, 70-2, and 70-3 to shift the inner bather devices 70-1, 70-2, and 70-3 between a closed position and an open position. For example, the shifting tool 73 is disposed adjacent the end valve 74 and below the inner bather devices 70-1, 70-2, and 70-3. As the shifting tool string 71 is axially pulled toward the surface, the shifting tool 73 shifts the end valve 74 from an open position shown in FIG. 6 to a closed position shown in FIG. 7. The shifting tool 73 also individually shifts each end inner barrier devices 70-1, 70-2, and 70-3 from the closed position shown in FIG. 6 to the open position shown in FIG. 7 as the shifting tool string 71 continues to be axially moved towards the surface of the wellbore 16. FIG. 7 shows the lower completion 29 in the inflow control position with the shifting tool string 71 removed. For example, the shifting tool 73 first engages end valve or sleeve 74 and shifts the end valve 74 to a closed position where it blocks return opening 38. The shifting tool 73 disengages from the end valve 74 when the shifting tool string is pulled with a predetermined force. The shifting tool 73 then axially moves to and engages inner barrier device 70-3, and then the inner bather device 70-3 is shifted to an open position where ICD 44-3 is not blocked by inner bather device 70-3. The other inner barrier devices 70-3 for other screens on the lower completion 29 can also be shifted in a similar manner as the shifting tool string is axially moved toward the surface of the wellbore 16. In some embodiments, the shifting tool 73 can be used to both open and close the end valve 74 and inner barrier devices 70-1, 70-2, and 70-3 by axially shifting the shifting tool 73 in the two axial directions such as upwards and downwards. The shifting tool string 71 can be connected to a deployment tool and removed from the wellbore after the shifting tool 73 has performed its shifting function and the deployment tool is removed from wellbore 16. The deployment tool may be a tubular such as drill pipe or coiled tubing or wireline.

The inner string disconnect assembly 54 allows the inner string 26 to be disconnected from the service tool 28. In one embodiment, the service tool 28 and inner string 26 are decoupled from the base pipe 20 to allow axially movement of the inner string 26 relative to the base pipe 20. After the barrier devices 42-1, 42-2, 42-3 have been moved to the inflow control position (after gravel packing), the anchoring assembly 52 can be actuated to secure or anchor the inner string 26 to the base pipe 20. The service tool 28 can be disconnected from the inner string 26 when the anchoring assembly 52 of the inner string 26 is in the anchored position. In one embodiment, the service tool 28 is pulled axially upward to apply a predetermined force to the inner string 26 to cause the inner string 26 to disconnect from the service tool 28 at the inner string disconnect assembly 54. The service tool 28 can be pulled axially upward with the drill pipe 31.

In operation, the lower completion assembly 29 including the base pipe 20, packer 22, filter media 24, and inner string 26 are coupled together at the surface. The lower completion assembly 29 is run into the wellbore 16 with the service tool 28 coupled to one end of the lower completion assembly 29. The filter media 24 is positioned adjacent to the hydrocarbon formation 14. In an embodiment, the bather devices (e.g., 42, 60, 62, 70, 72, 80, 82) are initially in the gravel packing position when lower completion assembly 29 is run in hole. The lower completion assembly 29 may be run into a production well for producing hydrocarbons. The lower completion assembly 29 also may be run into an injection well for injecting pressurized fluid into a formation for controlling pressure in the formation.

When the downhole tool 10 is at the desired position in the wellbore 16 (i.e., proximate the fluid-producing formation 14), the packer 22 is actuated to anchor the downhole tool 10 in place. After the packer 22 is set, the wellbore annulus 30 is gravel packed. The wellbore annulus may be gravel packed using different gravel packing methods including alpha-beta gravel packing and shunt gravel packing. Shunt gravel packing uses a downhole tool 10 that includes shunt tubes for carrying gravel slurry during the gravel packing operation. The gravel packing operation may include pumping a gravel slurry from the surface, through the service tool 28 and into the wellbore annulus 30, to gravel pack the annulus 30 including placing gravel from toe to the heel of the wellbore 16.

During the gravel packing operation, the gravel pack fluid circulates through the filter media 24, through the permeable sections 21-1, 21-2, 21-3 of the base pipe 20, into the inner string annulus 36 and into the interior of the inner string 26 through the first inner string flow path 48. The barrier devices (e.g., 42, 60, 62, 70, 72, 80, 82) are in the gravel packing position so pressure loss to the interior of the inner string 26 is limited. Pressure loss is limited because the gravel pack fluid is allowed to flow through the inner string annulus 36 to the return opening 38 without being blocked or obstructed by the barrier devices (e.g., 42, 60, 62, 72, 80, 82). The gravel pack fluid entering the inner string 26 is returned to surface through a return flow path.

After the gravel packing operation has placed gravel in the wellbore annulus 30, the barrier devices (e.g., 42, 60, 62, 70, 72, 80, 82) can be actuated from the gravel packing position to the inflow control position. In one embodiment, the barrier devices (e.g., 42, 60, 62, 70, 72, 80, 82) can be actuated to the inflow control position hydraulically, chemically, electrically, or mechanically. For example if the barrier devices (e.g., 42, 72) include a swellable or expandable element, such as a packer, the barrier devices (e.g., 42, 72) can swell or expand to the inflow control position after a time period of being exposed to hydrocarbon fluids or gravel packing fluids (see FIGS. 2 and 3). In another embodiment, the barrier devices (e.g., 60, 62, 80, 82) can be actuated from the gravel packing position to the inflow control position by axially moving the inner string 26 relative to the base pipe 20 (see FIGS. 4 and 5). This results in the barrier devices (e.g., bonded seals or O-rings) 62 being mated with the corresponding barrier devices (e.g., polished bore receptacles) 60. A user axially moves the inner string 26 to position the barrier devices (e.g., 62, 82) into the inflow control position by axially moving the attached service tool 28.

Production operations can begin when the barrier devices (e.g., 42, 60, 62, 70, 72, 80, 82) are in the inflow control position. In one embodiment, production operations can begin to flow hydrocarbons from the formation 14, through the inner string 26, through the service tool 28, and to the surface. The lower completion 29 is run in hole and the gravel packing operations and the positioning of the barrier devices between the gravel packing position and the inflow control position all occur in one trip or run into the wellbore.

In another embodiment, the service tool 28 is removed with the inner string 26 remaining downhole as part of the permanent lower completion assembly 29. The service tool 28 is removed, and an upper completion (not shown) is coupled to the lower completion assembly 29 for the production operations. More specifically, after the barrier devices (e.g., 42, 60, 62, 70, 72, 80, 82) have been actuated into the inflow control position, the inner string 26 can be anchored to the lower completion assembly 29 to prevent axial movement of the inner string 26 with respect to the base pipe 20. The inner string 26 is anchored to the base pipe 20 by actuating the anchoring assembly 52 to the anchored position. For example, the anchoring assembly 52 can expand to engage the base pipe 20 or other component connected to the base pipe 20.

After the inner string 26 has been anchored, the service tool 28 and inner string 26 can be disconnected from one another, and the service tool 28 can be run out of hole to the surface. In some embodiments, the inner string 26 includes the inner string disconnect assembly 54 that allows the service tool 28, including an upper section of the inner string 26 located above the inner string disconnect assembly 54, to disconnect from the inner string 26. The inner string 26 remains anchored to the base pipe 20 after the service tool 28 has been disconnected from the anchored inner string 26. The inner string 26 is connected to the base pipe 20 and forms a part of the permanent lower completion assembly 29. An upper completion can be coupled to the lower completion assembly 29 for the production operation of flowing hydrocarbons from the formation 14 to the surface. More specifically, the hydrocarbons flow through the filter media 24, through the permeable sections 21-1, 21-2, 21-3 of the base pipe 20, through the inner string annulus 36, through the inflow control devices 44-1, 44-2, 44-3 in the wash pipe 26, through the interior of the inner string 26, through the upper completion, and to the surface.

The above description of operations of the downhole tool 10 and lower completion assembly 29 have been described for production operations. The lower completion assembly 29 can also be used for other well treatments including filter cake removal and acidizing. The lower completion assembly 29 can also be used for injection operations. For example, although not shown, the downhole tool 10 can also be used for injection operations, whereby fluid is injected from the downhole tool 10 and into the formation 14. The downhole tool 10 may be used for completing a well for a producer, injector, oil, gas, or water well. In operation, the downhole tool 10 used in injection operations or when an injection well operates in a manner similar to that described for production operations or for a production well. The operations are the same through the gravel packing operation. After the gravel packing operation, the downhole tool 10 is adjusted from the gravel packing position to the inflow control position. Fluid then is pumped from the surface of the well through the downhole tool 10. For a section of base pipe 20, the pumped fluid flows from the interior of the inner tubular, through the inflow control devices 44-1, 44-2, 44-3, through the washpipe annulus 36, through the perforated sections of base pipe 20, and into the formation 14. Because the return opening 38 in the inner string 26 is blocked, an increased portion of the flow in the inner string 26 is directed to flow through the inflow control devices 44-1, 44-2, 44-3, rather than through the return opening 38. This provides for increased control in injecting fluid into the formation 14.

Figure 11:
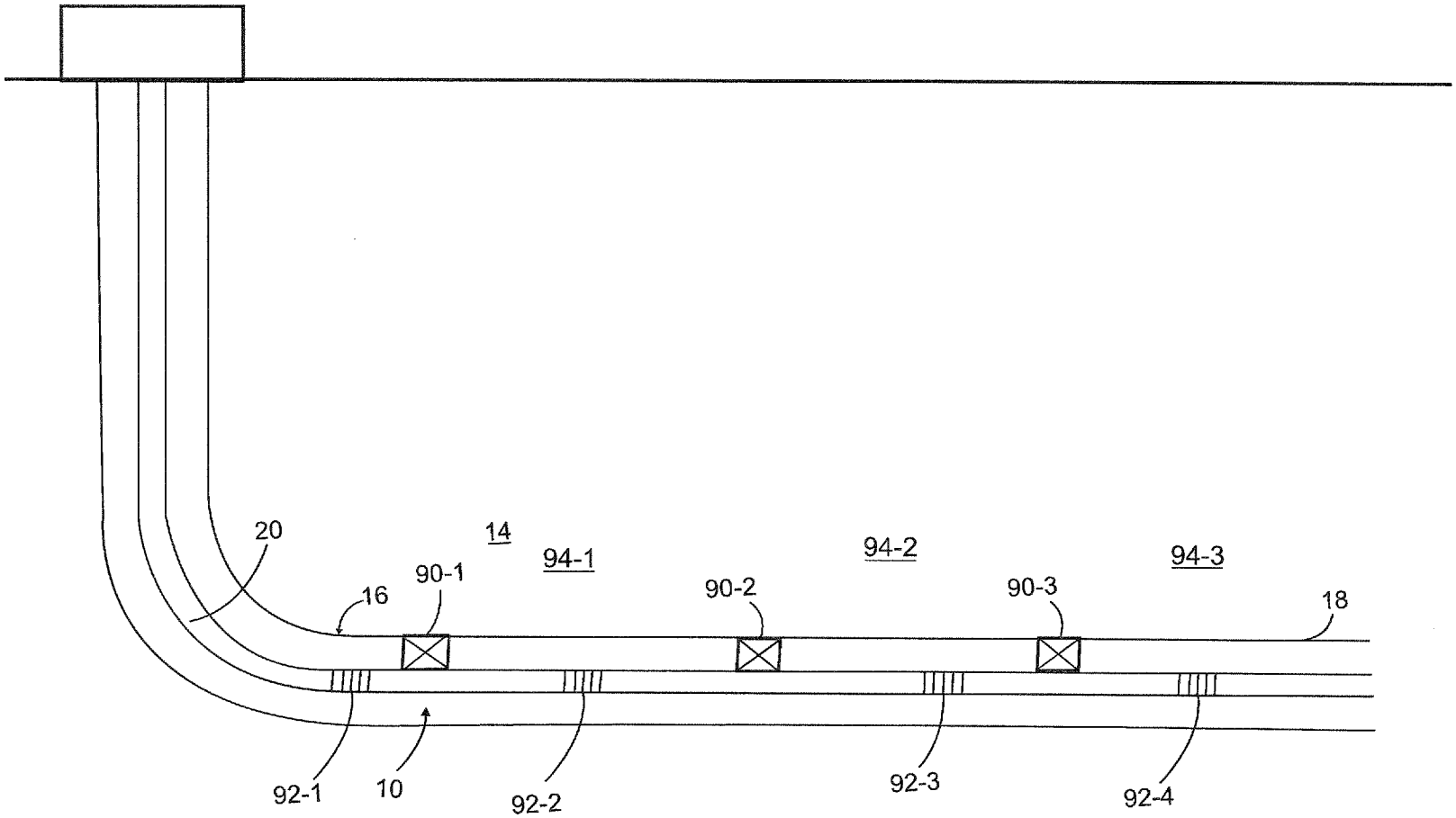
FIG. 11 depicts a cross-sectional side view of an illustrative downhole tool for gravel packing a wellbore, according to one or more embodiments disclosed.

FIG. 11 depicts a cross-sectional side view of an illustrative downhole tool 10 for gravel packing a wellbore 16, according to one or more embodiments. The downhole tool 10 is disposed in the wellbore 16 and is positioned adjacent to a hydrocarbon formation 14. The wellbore 16 can have a casing disposed therein, or the wellbore 16 can be openhole (i.e., no casing disposed adjacent the hydrocarbon formation 14), as shown in FIG. 11. The downhole tool 10 can include one or more screen sections 92-1, 92-2, 92-3, and 92-4. Each of the screen sections 92-1, 92-2, 92-3, and 92-4 can be on a joint of base pipe. Joints of blank base pipe (i.e., without production screen sections) can separate screen sections disposed in different formation zones 94-1, 94-2, and 94-3. One or more packers 90-1, 90-2, and 90-3 can be disposed between a base pipe 20 of the downhole tool 10 and a wall 18 of the wellbore 16. The one or more packers 90-1, 90-2, and 90-3 can be disposed axially between the one or more screen sections 92-1, 92-2, 92-3, and 92-4 as shown in FIG. 11. The one or more packers 90-1, 90-2, and 90-3 can compartmentalize the annulus between wall 18 of the wellbore 16 and the base pipe 20 into one or more zones, each containing the one or more screen sections 92-1, 92-2, 92-3, and 92-4 as shown in FIG. 11. Each of the screen sections 92-1, 92-2, 92-3, and 92-4 can include the inner string 26 extending within and axially through the screen sections 92-1, 92-2, 92-3, and 92-4. The inner string 26 can have barrier devices for a plurality of the screen sections shown axially separated and spaced between the packers 90-1, 90-2, and 90-3. Each of the screen sections 92-1, 92-2, 92-3, and 92-4 can be actuated between the gravel pack position and the inflow control position to control fluid flow through the different screen sections 92-1, 92-2, 92-3, and 92-4, as described in the different embodiments herein. In some embodiments, each screen section can be individually positioned between the gravel pack position and the inflow control position. This allows for zonal compartmentalization of the formation zones 94-1, 94-2, and 94-3 and the flow to or from the different zones 94-1, 94-2, and 94-3 to be individually controlled or shut-off using the barrier devices described in the different embodiments. In some embodiments, a shifting tool 73 can be disposed below the screen section 92-4. The barrier elements associated with each screen section 92-1, 92-2, 92-3, and 92-4 are shifted from closed positions to open positions as the shifting tool 73 is pulled past the screen sections 92-1, 92-2, 92-3, and 92-4.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

Although only a few example embodiments have been described in detail above, those skilled in the art will readily appreciate that many modifications are possible in the example embodiments without materially departing from "Single Trip Gravel Pack System and Method." Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §120, paragraph 6 for any limitations of any of the claims herein, except for those in which the claim expressly uses the words 'means for' together with an associated function.

Certain embodiments and features have been described using a set of numerical upper limits and a set of numerical lower limits It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for completing a well, comprising:

running a lower completion assembly into a wellbore adjacent to a subsurface formation in a single trip, wherein the lower completion assembly comprises:

a screen assembly;

an inner string positioned within the screen assembly to form an inner string annulus between the inner string and the screen assembly, the inner string having a return opening and at least one inflow control device communicating with an interior of the inner string; and a barrier device positioned to control flow along the inner string annulus, the barrier device being adapted to actuate between a gravel pack position for selectively permitting relatively unrestricted fluid flow of gravel pack fluid along the inner string annulus to the return opening, and an inflow control position that restricts flow along the inner string annulus to direct an increased proportion of fluid flow to pass through the inflow control device and into an interior of the inner string;

flowing gravel about the screen assembly with the barrier device in the gravel packing position during at least a portion of gravel pack operations; and actuating the barrier device to the inflow control position to restrict flow through the screen assembly during at least a portion of a well operation.

2. The method of claim 1, further comprising installing the lower completion assembly such that the screen assembly is adjacent to the subsurface formation, wherein the inner string is configured to move in an axial direction relative to the installed screen assembly, and wherein the flow of the gravel pack fluid is relatively unrestricted about the screen assembly through the inner string annulus to the return opening.

3. The method of claim 2, further comprising actuating the barrier device between the gravel packing position and the inflow control position by axially moving the inner string relative to the screen assembly.

4. The method of claim 2, further comprising axially moving the inner string after the screen assembly is installed to perform the well operation.

5. The method of claim 4, further comprising axially moving the inner string to position the barrier device in the gravel packing position after performance of the well operation.

6. The method of claim 5, wherein the barrier device includes a polished bore receptacle and O-ring seal for sealing the inner string annulus between the inner string and the screen assembly.

7. The method of claim 1, further comprising actuating the barrier device to the gravel packing position in response to contact between a material of the barrier device and fluid in the wellbore.

8. The method of claim 7, wherein the barrier device further comprises a swellable material mounted on the inner string, and further comprising swelling the swellable material in response to the fluid in the wellbore so as to increasingly restrict flow through the screen assembly during at least a portion of the swelling of the swellable material.

9. The method of claim 1, wherein the lower completion assembly is configurable to form a first isolated zone having a first inflow control device for isolating a first section of the screen assembly, and a second isolated zone having a second inflow control device for isolating a second section of screen assembly when the barrier device is in the gravel packing position, and further comprising actuating the barrier device into the inflow control position to form the first isolated zone and the second isolated zone where fluid flow from the first section of the screen assembly is blocked from the second isolated zone to force fluid flow into the inner string through the first inflow control device, and where fluid flow from the second section of the screen assembly is blocked from the first isolated zone to force fluid flow into the inner string through the second inflow control device.

10. The method of claim 1, further comprising a inner string anchoring assembly coupled to the inner string and configurable between a non-anchored position where the inner string anchoring assembly allows for axial movement of the inner string within and relative to the screen assembly, and an anchored position where the inner string is coupled to the screen assembly, and further comprising actuating the inner string anchoring assembly to the anchored position after the lower completion assembly has been run in the wellbore.

11. The method of claim 10, further comprising actuating the inner string anchoring assembly to the anchored position when the barrier device is in the inflow control position.

12. The method of claim 10, further comprising a service tool coupled to the inner string, wherein the service tool comprises a flow port for flowing the gravel from the interior of the service tool to the outside of the service tool to flow the gravel to the screen assembly.

13. The method of claim 10, further comprising a service tool coupled to the inner string assembly to form a tubular string, and further comprising:

removing the service tool from the wellbore with the inner string remaining disposed in the screen assembly; and flowing hydrocarbons through a bore of the inner string during production operations after the service tool has been removed.

14. The method of claim 10, further comprising a service tool coupled to the inner string to form a tubular string and a disconnect assembly configured to disconnect the service tool from at least a portion of the inner string, and further comprising actuating the disconnect assembly after the inner string anchoring assembly is positioned in the anchored position.

15. The method of claim 14, wherein the screen assembly is attached to a packer, and the service tool is releasably coupled to the packer, and further comprising:

running the lower completion assembly into the wellbore with the service tool coupled to the lower completion assembly;

setting the packer to install the screen assembly adjacent to the subsurface formation;

decoupling the service tool from the packer;

axially moving the decoupled service tool and attached inner strength within the installed screen assembly;

flowing the gravel about the screen assembly after axially moving the decoupled service tool and attached inner string;

actuating the inner string anchoring assembly after axially moving the decoupled service tool and attached inner string;

removing the service tool from the wellbore with the inner string remaining disposed in the screen assembly; and flowing hydrocarbons through a bore of the inner string during production operations after the service tool has been removed.

16. The method of claim 1, wherein during at least a portion of gravel pack operations with the barrier device in the gravel packing position, gravel pack carrier fluid flows through the screen assembly to the interior of the inner string through a circulation flow path, wherein the circulation flow path extends from the inner string annulus to the return opening, and wherein during at least a portion of production operations with the barrier device in the inflow control position, the circulation flow path is blocked to restrict flow to the return opening so that an increased portion of fluid flow through the screen assembly flows through the at least one inflow control device.

17. A well system, comprising:

a screen assembly;

an inner tubular disposed in the screen assembly to form an inner string annulus between the inner tubular and the screen assembly, the inner tubular having at least one inflow control device and a return opening;

a barrier device disposed between the inner tubular and the screen assembly, the barrier device being configurable between a gravel pack position for selectively permitting relatively unrestricted flow of fluid along the inner tubular annulus to the return opening, and an inflow control position that reduces axial flow of fluid along the inner tubular annulus so as to direct an increased proportion of flow to pass through the inflow control device and radially through the inner tubular into an interior of the inner tubular; and a packer proximate the screen assembly, wherein the packer is actuated when the barrier device is in the gravel packing position.

18. A method for completing a well, comprising:

running a lower completion assembly into a wellbore adjacent to a subsurface formation in a single trip, wherein the lower completion assembly comprises:

a screen assembly;

an inner string disposed in the screen assembly to form an inner string annulus between the inner string and the screen assembly, the inner string having at least one inflow control device;

a barrier device disposed between the inner string and the screen assembly, the barrier device being configurable between a first position allowing a flow of fluid axially along the inner string annulus and a second position which restricts the flow of fluid along the inner string annulus to provide pressure loss during at least a portion of a first well operation that is less than the pressure loss through at least a portion of a second well operation, the restriction to flow of fluid along the inner string annulus causing increased fluid flow radially through the inner string via the inflow control device;

flowing gravel about the screen assembly with the barrier device in the first position during at least a portion of the first well operation; and actuating the barrier device during the second well operation to the second position to restrict flow through the screen assembly.

19. The method of claim 18, wherein the barrier device is configurable to form a first isolated zone having a first inflow control device for isolating a first section of the screen assembly and a second isolated zone having a second inflow control device for isolating a second section of screen assembly when the barrier device is in the first position, further comprising actuating the barrier device into the second position to form the first isolated zone and the second isolated zone where fluid flow from the first section of the screen assembly is blocked from the second isolated zone to force fluid flow into the inner string through the first inflow control device, and were fluid flow from the second section of the screen assembly is blocked from the first isolated zone to force fluid flow into the inner string through the second inflow control device.

20. The method of claim 19, further comprising actuating the barrier device between the first position and the second position by axially moving the inner string relative to the screen assembly.

* * * * *